US008393336B2

(12) United States Patent
Abergel et al.

(10) Patent No.: US 8,393,336 B2
(45) **Date of Patent: *Mar. 12, 2013**

(54) PACKAGING AND APPLICATOR DEVICES AND KITS, AND METHODS OF APPLICATION

(75) Inventors: Aline Abergel, Boulogne (FR); Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/184,465

(22) Filed: Jul. 15, 2011

(65) Prior Publication Data

US 2011/0268493 A1 Nov. 3, 2011

Related U.S. Application Data

(63) Continuation of application No. 11/743,425, filed on May 2, 2007, now Pat. No. 8,267,097.

(60) Provisional application No. 60/808,133, filed on May 25, 2006.

(30) Foreign Application Priority Data

May 2, 2006 (FR) ..... 06 51557

(51) Int. Cl.
*A45D 29/00* (2006.01)

(52) U.S. Cl. ..... 132/73; 401/11

(58) Field of Classification Search ..... 132/286, 132/73, 73.5, 317, 318, 320; 401/9, 11, 130; 206/229, 581, 823, 81

See application file for complete search history.

(56) References Cited

U.S. PATENT DOCUMENTS

| | | | |
|---|---|---|---|
| 2,279,520 | A | 4/1942 | Perillo |
| 4,944,318 | A | 7/1990 | Gaylord et al. |
| 6,220,254 | B1 | 4/2001 | Gueret |
| 6,267,950 | B1 | 7/2001 | De la Poterie et al. |
| 8,267,097 | B2 | 9/2012 | Abergel et al. |
| 2003/0053839 | A1 | 3/2003 | Dumler et al. |
| 2005/0072355 | A1 | 4/2005 | Petit |
| 2008/0185013 | A1 | 8/2008 | Abergel et al. |

FOREIGN PATENT DOCUMENTS

| | | | |
|---|---|---|---|
| DE | 36 10 007 | A1 | 2/1986 |
| EP | 0 916 282 | A1 | 5/1999 |
| EP | 1 243 200 | A2 | 1/2000 |
| EP | 1 080 659 | A2 | 3/2001 |
| FR | 1 174 544 | | 3/1959 |
| FR | 1 409 201 | | 7/1965 |
| FR | 2 836 029 | | 8/2003 |
| FR | 2 860 402 | A1 | 10/2007 |
| GB | 918901 | | 2/1963 |
| JP | 2001-197932 | A | 7/2001 |
| WO | WO 2006/032482 | A1 | 3/2006 |
| WO | WO 2006-068857 | A1 | 6/2006 |

OTHER PUBLICATIONS

European Search Report in European Patent Application No. EP 07 30 0994, having a mail date of Dec. 13, 2010.

Written Opinion in European Patent Application No. EP 07 30 0994, referring to Form 1507 having a mailing date of Dec. 13, 2010.

(Continued)

*Primary Examiner* — Rachel Steitz

(74) *Attorney, Agent, or Firm* — O'Brien Jones, PLLC

(57) ABSTRACT

A packaging and applicator kit may comprise a receptacle containing a substance for application to nails that has a viscosity of at least approximately 0.3 Pa·s. The kit may also comprise at least one applicator configured to be loaded with the substance contained in the receptacle and to apply the substance to nails. The at least one applicator may comprise at least one flexible blade defining an application face.

14 Claims, 6 Drawing Sheets

OTHER PUBLICATIONS

Translated Written Opinion in European Patent Application No. EP 07 30 0994, referring to Form 1507 having a mailing date of Dec. 13, 2010.

Abstract of DE 36 10 007 A1.

Abstract of FR 2 836 029.

French Search Report from French Application No. FR 06 51557 filed May 2, 2006.

Office Action dated Jun. 18, 2010 from co-pending U.S. Appl. No. 11/743,425.

Office Action dated Mar. 10, 2011 from co-pending U.S. Appl. No. 11/743,425.

Response to Office Action dated Dec. 17, 2010 from co-pending U.S. Appl. No. 11/743,425.

Response to Office Action dated Jun. 9, 2011 from co-pending U.S. Appl. No. 11/743,425.

French Search Report from French Application No. FR 06 51557, dated Feb. 19, 2007.

Abstract of DE 36 10 007 A1, original German document dated Mar. 25, 1986.

Abstract of FR 2 836 029, original French document dated Aug. 22, 2003.

PACKAGING AND APPLICATOR DEVICES AND KITS, AND METHODS OF APPLICATION

This application is a continuation of U.S. patent application Ser. No. 11/743,425, filed May 2, 2007 now U.S. Pat. No. 8,267,097, claims the benefits of priority of U.S. Provisional Application No. 60/808,133, filed May 25, 2006, and the benefits of priority under 35 U.S.C. §119 to French Application No. 06 51557, filed May 2, 2006, the entire contents of each of which are incorporated herein by reference.

FIELD

The present invention relates to packaging and applicator devices, kits, and methods for applying a substance to a keratinous material, such as, for example, to nails (e.g., fingernails and/or toenails).

BACKGROUND

Nail varnishes and care products for the nails are often applied by brushes that are made by stapling a tuft of bristles to the end of a stem.

Such brushes are generally satisfactory for substances of substantially liquid consistency.

However, for more viscous substances, conventional brushes may not yield good results. For example, the bristles may form stripes on the surface of the substance that remain after the substance has dried.

French patent 1 409 201 discloses an applicator having a handle that is curved and made of an elastically-deformable material so as to enable the user to exert light pressure on the sides of the handle so as to narrow or widen the opening of the bundle of bristles in order to adapt it to the width of the nail being treated. That applicator presents the above-mentioned drawback.

Nail varnish applicators that do not have bristles also have been proposed.

European patent application EP 0 916 282 A1 discloses an applicator comprising an applicator element that presents a curved shape. The applicator may be housed in a receptacle provided with a wiper member that is constituted, at least in part, by an elastically-deformable porous material. The presence of the wiper member may make it difficult for the user to control the quantity of composition taken by the applicator.

French patent 2 836 029 describes devices for producing a "French Manicure" effect that involves depositing a white composition at the end of varnished nails in order to imitate the whites of the nails.

French patent 1 174 544 discloses an applicator comprising a stem that is provided at one end with a plane blade having a distal edge that is rectilinear. When not in use, the stem is inserted in a narrow-necked receptacle.

International Publication WO 2006/068857 discloses a device for applying makeup to the nails. The device may include a plurality of differing-sized protrusions that are interconnected via a central hub.

SUMMARY

It may be desirable to provide an applicator that is configured to apply a substance that has a relatively viscous consistency to keratinous materials, such as nails, for example. As used herein, relatively viscous consistency may be used to refer to substances that have a viscosity of at least about 0.3 Pascal seconds (Pa·s.) In the field of substances configured for application for nails, such substances having a relatively viscous consistency may have a viscosity greater than the viscosity of nail varnishes and/or nail care products that often are conventionally applied using a brush.

Although the present invention may obviate one or more of the above-mentioned needs, it should be understood that some aspects of the invention might not necessarily obviate one or more of those needs.

In the following description, various aspects and embodiments will become evident. In its broadest sense, the invention could be practiced without having one or more features of these aspects and embodiments. Further, these aspects and embodiments are exemplary.

According to one exemplary embodiment, the invention may include a packaging and applicator kit that comprises a receptacle containing a substance for application to nails, the substance having a viscosity of at least about 0.3 Pascal seconds (Pa·s.). The kit also may include at least one applicator configured to be loaded with at least some of the substance contained in the receptacle and to apply the at least some substance to at least one nail, wherein the at least one applicator comprises at least one flexible blade defining an application face.

According to various exemplary embodiments, an applicator may comprise at least one flexible blade having a curvature and the application face may be generally concave. In various exemplary embodiments, a distal edge of the flexible blade may be convex when observed from above (e.g., when observed from a side of the applicator that faces in a direction substantially opposite to the application face).

According to another exemplary embodiment, an applicator configured to be loaded with a substance contained in a receptacle and to apply the substance to nails may comprise at least one curved flexible blade having an application face that defines a developable surface, such as, for example, a cylindrical surface.

The term "developable surface" as used herein may refer to a surface that can be unfolded, unrolled, or flattened onto a planar surface without stretching, tearing, shrinking, compressing or otherwise distorting the surface. Other nonlimiting examples of developable surfaces that the application face may define include cones and planes. Those skilled in the art would recognize a variety of various developable surface configurations that may be suitable.

In one exemplary embodiment, the invention also may include a packaging and applicator kit that comprises at least one applicator, such as, for example, any of the applicators described above, and a receptacle containing a substance for application to nails. The receptacle may be configured so as to permit the at least one applicator to be loaded with at least some of the substance without passing the at least one applicator through a wiper member.

The exemplary characteristics and/or features presented above may apply to both the applicator considered in isolation, and a kit comprising at least one applicator and the receptacle.

In accordance with various exemplary embodiments, a user may control, in a relatively accurate manner, the quantity of substance loaded onto the applicator based, for example, on factors such as the consistency of the substance and/or the way in which the substance is loaded.

For example, a curved shape of the flexible blade may facilitate loading the applicator with the substance.

Moreover, the absence of a bundle of bristles, as is found in conventional applicators for applying substance to nails, may make it possible to avoid the formation of stripes while the substance is being deposited (e.g., applied) on the nail.

The shape of the flexible blade also may facilitate application of substance to the nails, and may make it possible to achieve relatively good quality application (e.g., makeup) relatively quickly.

The viscosity of the substance is measured at 25° C. by means of a RHEOMAT 180 viscometer (LAMY) fitted with an MS-R1, MS-R2, MS-R3, MS-R4, or MS-R5 moving body that is selected as a function of the consistency of the substance, and turning at 200 revolutions per minute (rpm). The measurement is performed after about 10 minutes of rotation.

The flexible blade may, in exemplary embodiments, have an at least substantially smooth application face.

According to various exemplary embodiments, the flexible blade may include portions in relief on longitudinal sides of the application face. The portions in relief may include, for example, splines, protrusions, and/or other similar suitable relief portions. The portions in relief may be configured to bear against, for example, a finger and/or against the side of the nail so as to keep at least a portion of the application face spaced from the surface of the nail by a predefined distance. This may facilitate application of a controlled (e.g., uniform) thickness of substance to the nail.

The flexible blade may define substantially opposite bearing surfaces configured for a user's fingers to grasp so as to make it possible for the user to modify, as desired, the curvature of the application face by squeezing the flexible blade between the fingers to a greater or lesser extent. By way of example, the bearing surfaces may be defined by wing portions that extend on either side of a top wall of the blade that defines a rear side (e.g., a side that faces in a direction opposite to the application face) thereof.

The flexible blade may, in some embodiments, have a thickness that is not constant (nonuniform). Such nonuniform thickness may enable increased flexibility of the blade during use. Further, the increased flexibility may reduce the pressure exerted by the blade on the nail, which may improve comfort in applying the substance and/or the quality of said application (e.g., makeup).

In exemplary embodiments, the flexible blade may comprise a top wall with wing portions disposed on either side of the top wall. The top wall may have a wall thickness that is less than the thickness of the wing portions. During application, the top wall may therefore curve relatively easily. In other exemplary embodiments, the wing portions may have a wall thickness that is less than the thickness of the top wall. This may facilitate deformation of the distal edge of the blade by a user squeezing on the wing portions, due to more effective transmission of the exerted pressure to the distal edge. In this way, it may be possible for the user to control the deformation of the distal edge more easily. Further, it may thus be possible to provide a greater distance between the bearing region of the applicator that the fingers grasp (e.g., squeeze) and the region of the applicator carrying the composition.

The flexible blade may be connected to a handle. By way of example, the flexible blade may comprise a relatively thicker portion that may, in exemplary aspects, have a solid, circular cross-section. In various exemplary embodiments, the flexible blade may be made integrally with the handle, for example, by molding. In various other exemplary embodiments, the flexible blade may be made separately from the handle and attached thereto, either by a user or by a manufacturer of the applicator.

In various exemplary embodiments, the flexible blade may be made of a thermoplastic elastomer or of any other material that is capable of imparting flexibility to the blade and that is compatible with any solvent(s) contained in the substance.

The flexible blade may be made of an elastically-deformable material presenting hardness on the Shore A scale ranging from about 25 to about 60, for example.

The flexible blade may be made of flexible metal and/or of a laminate comprising a plurality of layers of differing materials that are laminated together or connected together by overinjection, for example.

In various exemplary embodiments, the flexibility of the blade may be such that the blade substantially flattens when pressed against a plane surface.

At least some parts of the blade may include a reinforcing member and/or a fiber filler.

As mentioned above, the flexible blade may have a distal edge that is convex when observed from above (e.g., from a rear side of the applicator that faces in a direction substantially opposite to the application face). By way of example, the tip of the distal edge may have a radius of curvature that ranges from about 4 millimeters (mm) to about 20 mm.

The flexible blade may have a shape that is substantially symmetrical about a longitudinal mid-plane.

The flexible blade may be flocked.

As mentioned above, in various exemplary embodiments, the applicator may include a handle onto which the blade is attached (e.g., fastened). In yet other exemplary embodiments, the flexible blade may be made with a handle portion resulting from molding and/or from forming a cutout therein. The longitudinal axis of the blade may coincide with the longitudinal axis of the handle or of the handle portion, or it may form a non-zero angle therewith.

When a handle is used, the flexible blade may be fastened either in a fixed manner to the handle or in a removable manner.

According to various exemplary embodiments, the applicator may include at least one adjustment member for adjusting a curvature of the application face. The adjustment member may be configured to serve as a handle.

The flexible blade may be fastened in an adjustable manner on the handle. The handle and the flexible blade may cooperate in such a manner as to make it possible for the user to vary a shape of the application face, for example, to adapt the shape of the application face to that of the nail being treated and/or to the consistency of the substance.

When the applicator includes a handle, and when the blade is movable relative to the handle, the handle may be arranged in such a manner as to stress (deform) the blade, to a greater or lesser extent, depending on its position on the handle. Such deformation may be elastic deformation, for example.

At least one of the blade and the handle may include portions in relief configured to adjust the curvature of the application face incrementally. Alternatively, the adjustment may occur in a substantially continuous manner.

The handle may, in exemplary embodiments, include at least one adjustment member movable relative to the blade. Upon being displaced relative to the blade, the adjustment member may modify the curvature of the application face.

Modification to the curvature of the application face may occur via various mechanisms. For example, modification to the curvature may result from stress being exerted laterally on two substantially opposite outer sides (e.g., longitudinal sides) of the blade and/or from stretching said blade (e.g., longitudinally and/or laterally) to a greater or lesser extent.

By way of example, stress may be exerted on the blade by the handle or by some other adjustment member, such as, for example, a ring or loop that is engaged on the blade and that is axially movable relative to the blade. By displacing the adjustment member along the blade, the blade may be squeezed to a greater or lesser extent, and it may curve in corresponding manner.

In various exemplary embodiments, the blade may define at least one opening (e.g., a hole or recess). This may increase the degree to which the nail can be seen while substance is being applied to the nail. Further, such a hole may permit assembly of the blade on a handle in such a manner so as to facilitate modification of the curvature of the application face. The blade may include a hole and have a tongue between two opposite edges of the opening.

The blade may be arranged so as to make it possible to stretch the blade, to a greater or lesser extent, between two opposite edges of the opening.

In one exemplary aspect, the blade may be made of a transparent material that may increase the degree to which the nail can be seen during application of the substance.

In accordance with various exemplary embodiments, the blade may be made of a material that facilitates cleaning. For example, the blade may be made of a polymer onto which the substance adheres relatively poorly, such as, for example, a silicone polymer.

The applicator may include two application faces of differing dimensions. Those application faces may be defined by a first flexible blade and a second flexible blade that are disposed end to end, for example. The user may thus select which of the first and second blades is to be used for application, and may use the other blade as a handle portion. The first and second blades may be made integrally by molding or by being cut out from a sheet, and may then be shaped.

The applicator may, in exemplary embodiments, be configured as a single-use applicator. In an exemplary embodiment, the kit may comprise a plurality of applicators that correspond to the expected number of uses, for example, based on the quantity of substance contained in the receptacle.

The plurality of applicators may be separate from one another or there may be at least two applicators secured to a common support. This may facilitate manufacture and packaging, with the applicators being molded and/or precut with the support and separable from the support by a user at the time of use.

By way of example, a plurality of applicators may be precut in a sheet that is made available to the user in combination with a receptacle containing the substance. In other words, the plurality of applicators and the receptacle containing the substance may be provided together in common packaging.

In various embodiments wherein a plurality of applicators are secured to a common support, the applicators may be identical and correspond to a plurality of successive uses, for example, or at least some of the applicators may differ from others (e.g., in terms of size, shape, profile, material, flexibility, and/or other characteristics) and may be configured for differing sized and shaped nails, for example. By way of example only, applicators of differing sizes and/or shapes may be configured to apply substance to toenails and fingernails, respectively.

In various exemplary embodiments, the receptacle may include a lid that defines a housing configured to receive at least in part, at least one applicator when not in use.

The housing may optionally extend along an axis that is oblique relative to the axis of the receptacle, which may improve stability of the kit.

According to yet another exemplary embodiment, the invention may include a method of applying a substance to nails, the method may comprise loading the at least one applicator comprising at least one flexible blade defining an application face according to any of the above-described exemplary embodiments with a substance from a receptacle and applying the substance to a nail using the application face of the at least one flexible blade. The substance being loaded and applied may have a viscosity of at least about 0.3 Pa·s.

Before or after the substance is loaded onto the applicator, the flexible blade may be deformed to modify a curvature of the blade such that the curvature of the blade substantially corresponds to a curvature of the nail. By way of example, the blade may be deformed either by exerting an action directly on the blade (e.g., a user applying force to the blade), or by an adjustment member applying force to the blade to thereby adjust the curvature.

In yet other exemplary embodiments, the invention may include at least one applicator for applying a substance to nails. The applicator may include at least one flexible blade defining an application face that is concave and the at least one flexible blade may be provided, on its longitudinal sides, with portions in relief for coming to bear against a nail and/or finger during application of the substance to the nail. The relief portions may be configured so as to form a gap of predefined thickness between the application face and the nail during application of substance to the nail. By way of example, the portions in relief may comprise splines or other similar protrusions that extend along the longitudinal sides of the application face. The portions in relief may contribute to containing the substance on the application face.

According to various exemplary embodiments, an applicator for applying a substance to nails may comprise a handle portion and at least one flexible blade defining an application face, the at least one flexible blade being made integrally with a handle portion. By way of example, the at least one flexible blade may be made by being cut out from sheets of material or by being molded with the handle portion. The handle portion may also define an application face.

According to various exemplary embodiments, an applicator for applying a substance to nails may comprise a flexible blade defining an application face. The flexible blade may define an opening (e.g., hole) and the application face may extend at least partially on either side of the opening.

According to yet further various embodiments, a packaging and applicator kit may comprise a receptacle containing a substance for application to nails and at least one applicator comprising at least one flexible blade configured to be loaded with at least some of the substance from the receptacle and to apply the at least some substance to the nails. The receptacle may comprise a closure cap or a support housed in the receptacle. The closure cap or support may define a housing in which the at least one flexible blade may be received, at least in part, when not in use.

By way of example, the housing may be defined by a chimney in which the at least one flexible blade can be inserted when not in use. The at least one flexible blade may be secured to a handle that extends out of the housing, for example. The housing may also be defined by the inside of a closure cap that is itself configured to mate with a lid to close the housing. The support may be arranged so as to bear against a top end of the receptacle. The closure member may bear against the support at its periphery, so as to contribute to sealing the closure member housing, for example.

BRIEF DESCRIPTION OF THE DRAWINGS

Both the foregoing general description and the following detailed description are exemplary and explanatory, and neither restricts nor limits the invention.

The accompanying drawings, which are incorporated in and constitute a part of this specification, illustrate several exemplary embodiments and, together with the description, serve to explain various principles and features.

Figure 1:
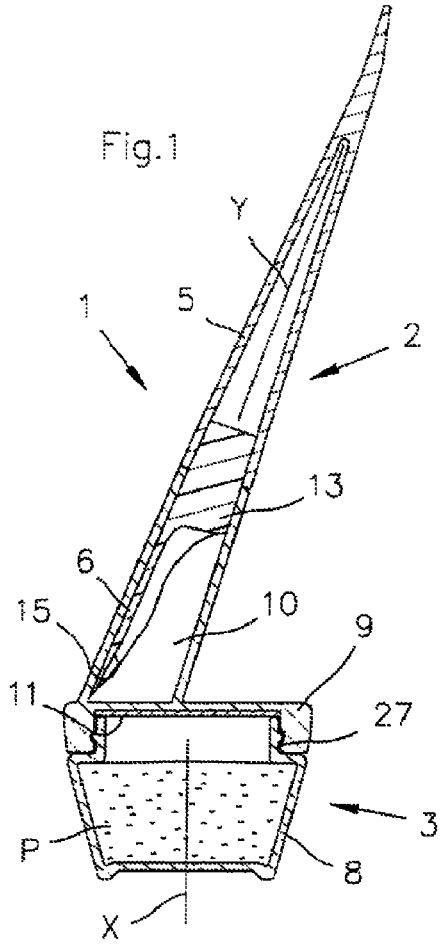
Figure 2:
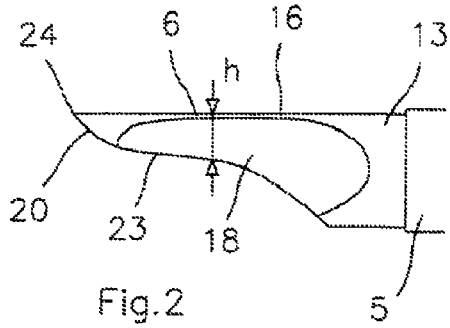
Figure 3:
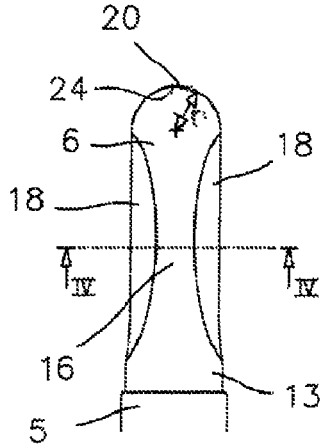
Figure 4:
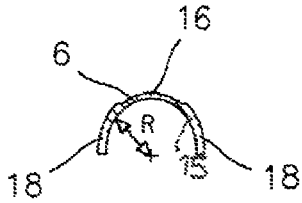
Figure 5:
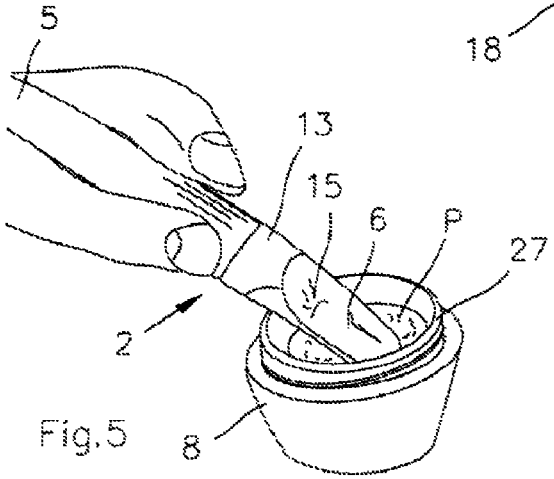
Figure 10:
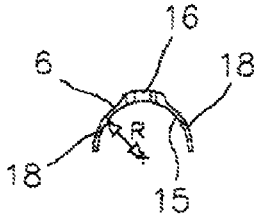
Figure 6:
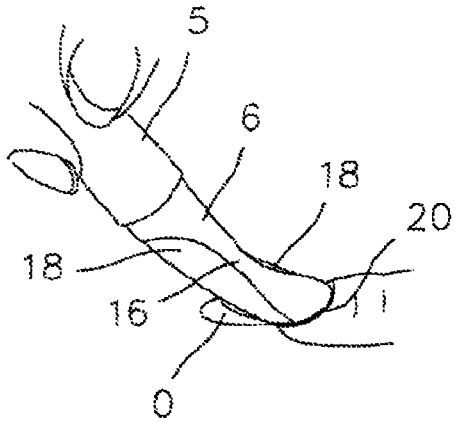
Figure 8:
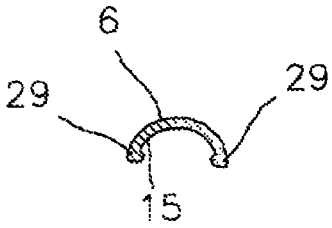
Figure 7:
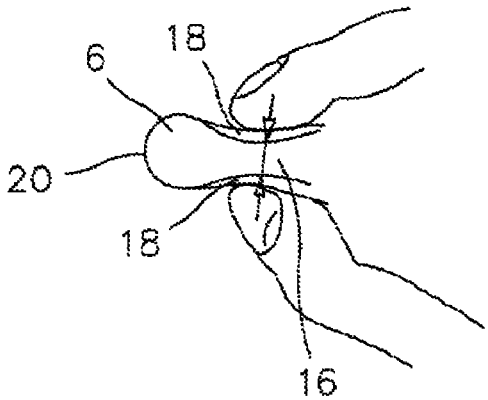
Figure 9:
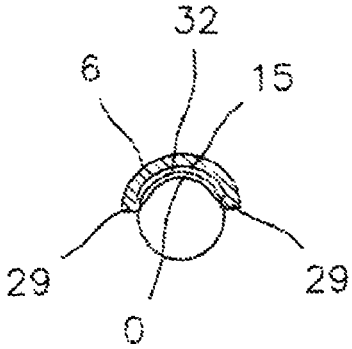
Figure 14:
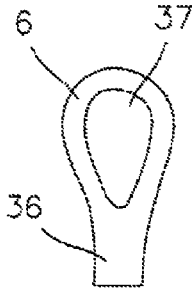
Figure 12:
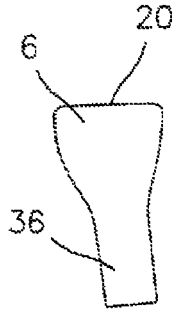
Figure 13:
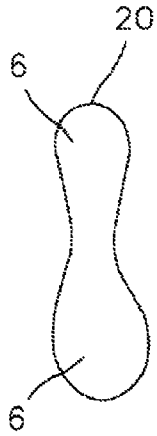
Figure 11:
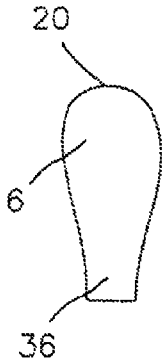
Figure 15:
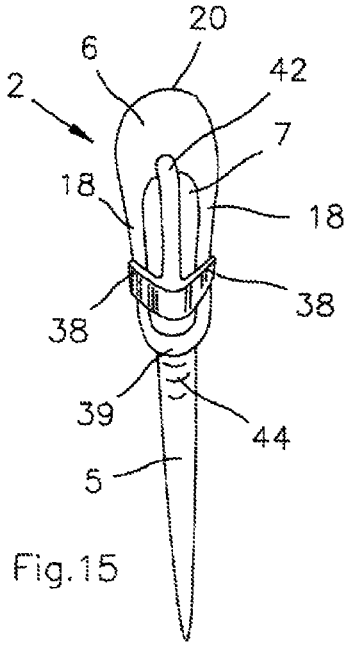
Figure 16:
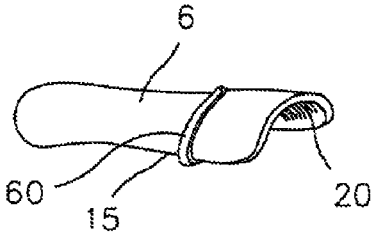
Figure 20:
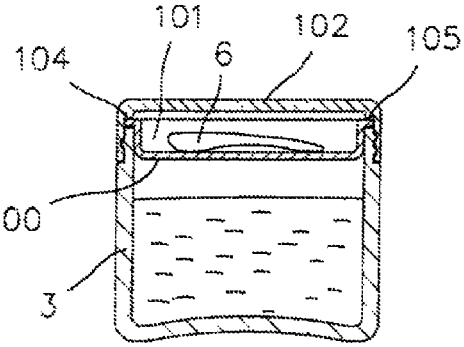
Figure 21:
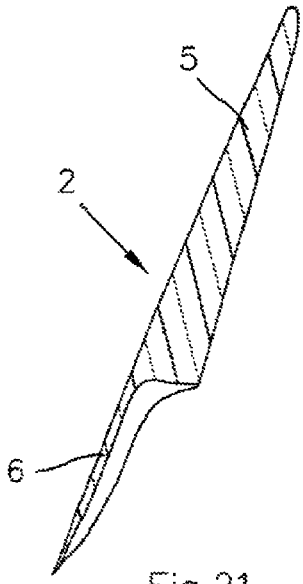
Figure 17:
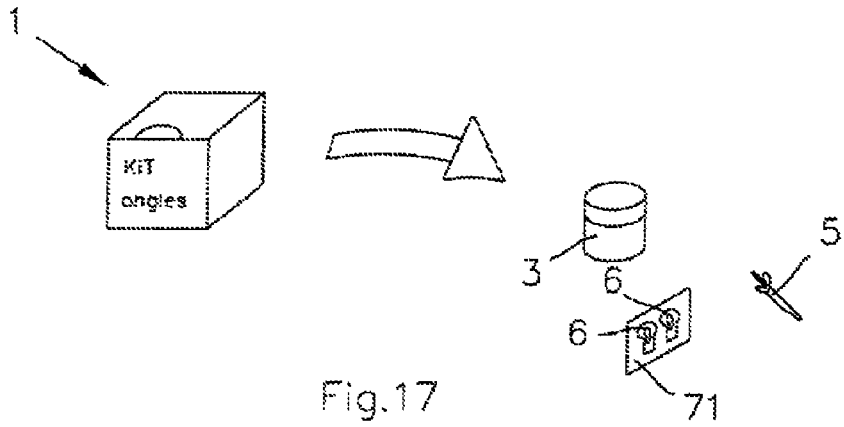
Figure 19:
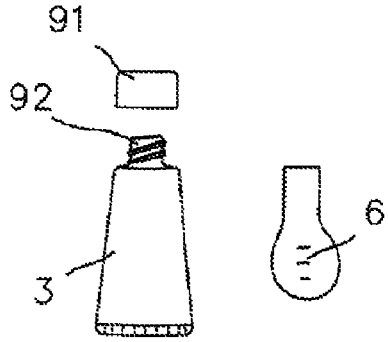
Figure 18:
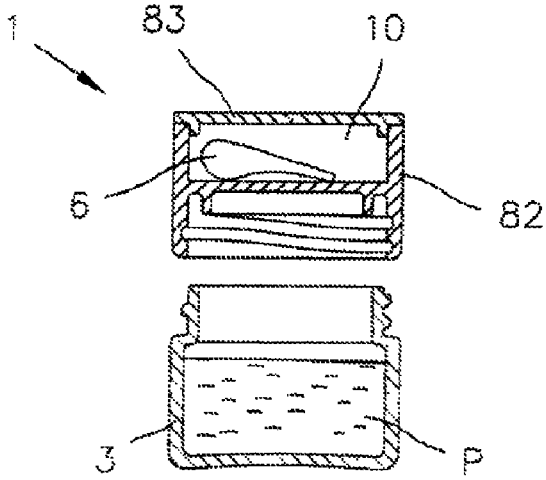
Figure 22:
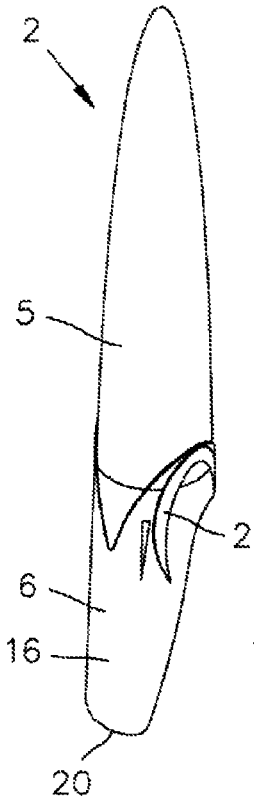
Figure 23:
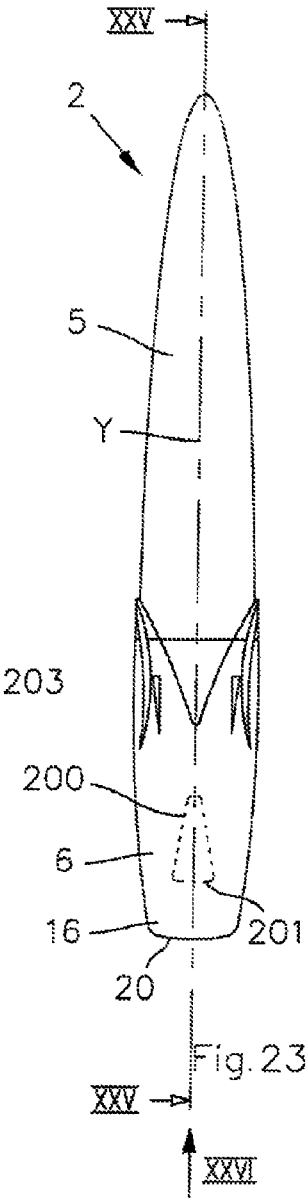
Figure 24:
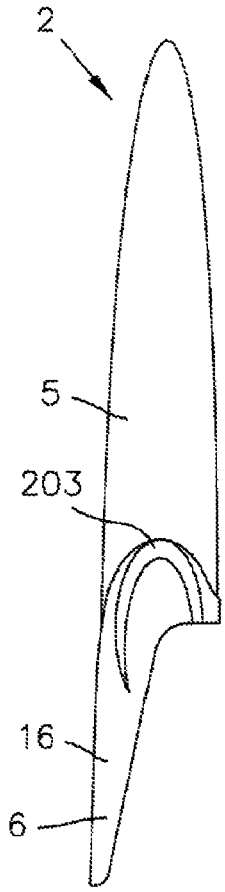
Figure 25:
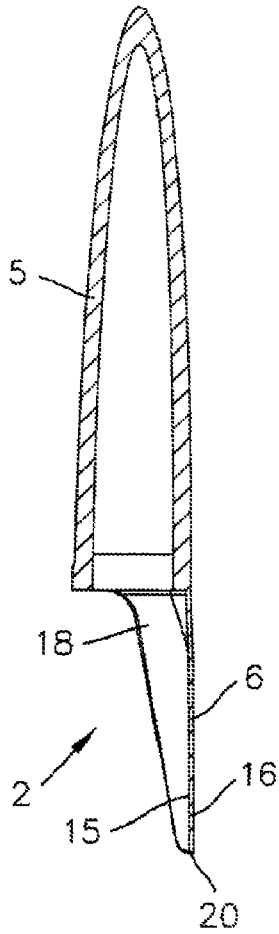
Figure 26:
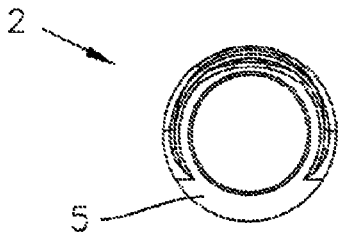
Figure 28:
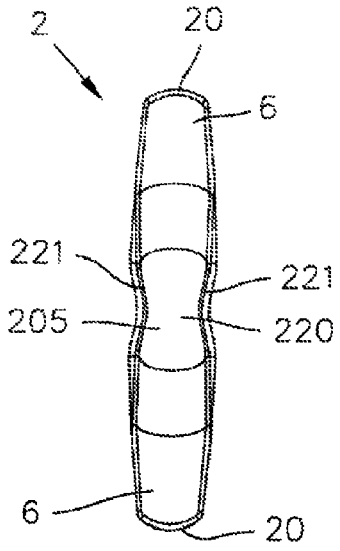
Figure 29:
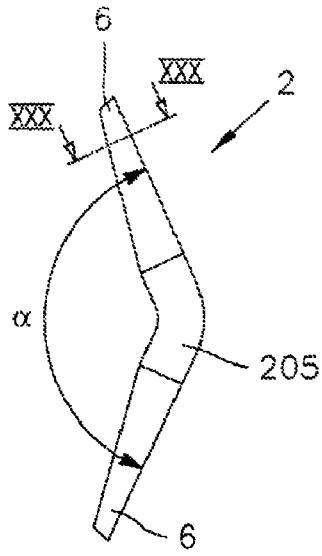
Figure 27:
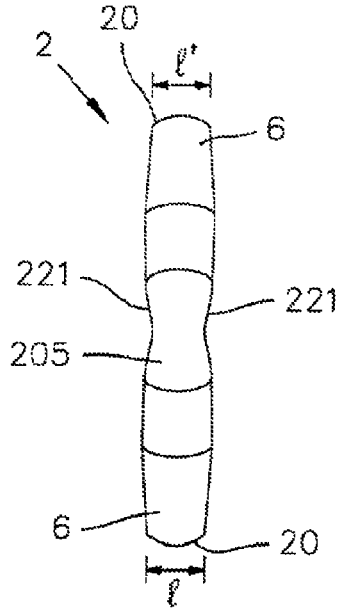
Figure 31:
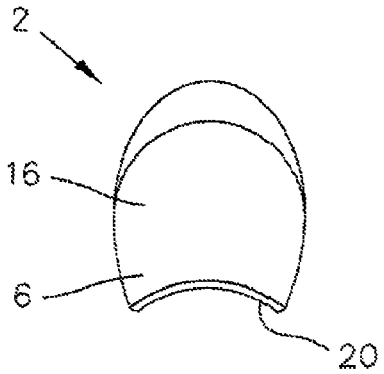
Figure 30:
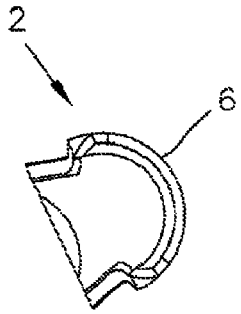
Figure 32:
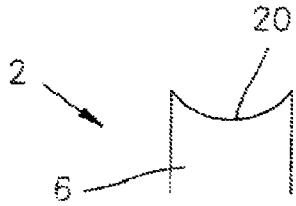

The invention may be better understood from reading the following detailed description of non-limiting exemplary embodiments, and from the accompanying drawings, in which:

FIG. 1 is a schematic longitudinal section of an exemplary embodiment of a packaging and applicator kit according to various aspects of the present teachings;

FIG. 2 is a partial side view of the applicator of FIG. 1;

FIG. 3 is a partial plan view of the applicator of FIG. 1;

FIG. 4 is a cross-sectional view taken from IV-IV of FIG. 3;

FIG. 5 shows an exemplary embodiment of loading the applicator of FIG. 1;

FIG. 6 shows an exemplary embodiment of applying a substance to a nail using the applicator of FIG. 1;

FIG. 7 shows an exemplary embodiment of using the applicator of FIG. 1;

FIG. 8 is a cross-sectional view of another exemplary embodiment of an applicator according to various aspects of the present teachings;

FIG. 9 is a cross-sectional view of the applicator of FIG. 8 during application of a substance to a nail according to an exemplary embodiment;

FIG. 10 is a cross-sectional view of yet another exemplary embodiment of an applicator according to various aspects of the present teachings;

FIG. 11 is a schematic plan view of another exemplary embodiment of an applicator according to various aspects of the present teachings FIG. 12 is a schematic plan view of another exemplary embodiment of an applicator according to various aspects of the present teachings;

FIG. 13 is a schematic plan view of yet another exemplary embodiment of an applicator according to various aspects of the present teachings;

FIG. 14 is a schematic plan view of yet another exemplary embodiment of an applicator according to various aspects of the present teachings;

FIG. 15 is a schematic perspective view of an exemplary embodiment of an applicator according to aspects of the present teachings;

FIG. 16 is a schematic perspective view of yet another exemplary embodiment of an applicator according to aspects of the present teachings;

FIG. 17 is an exemplary embodiment of packaging and applicator kit according to aspects of the present teachings;

FIG. 18 is another exemplary embodiment of packaging and applicator kit according to aspects of the present teachings;

FIG. 19 is another exemplary embodiment of a packaging and applicator kit according to aspects of the present teachings;

FIG. 20 is yet another exemplary embodiment of packaging and applicator kit according to aspects of the present teachings;

FIG. 21 is a schematic perspective view of another exemplary embodiment of an applicator according to aspects of the present teachings;

FIG. 22 is a schematic perspective view of yet another exemplary embodiment of an applicator according to aspects of the present teachings;

FIG. 23 is a view of the applicator of FIG. 22 in a direction facing opposite to the application face;

FIG. 24 is a side view of the applicator of FIG. 22;

FIG. 25 is a cross-sectional view taken from XXV-XXV of FIG. 23;

FIG. 26 is an axial view of the applicator of taken from the direction of XXVI in FIG. 23;

FIG. 27 is a plan view of yet another exemplary embodiment of an applicator according to aspects of the present teachings;

FIG. 28 is a view of the applicator of FIG. 27 showing the opposite facing portion of the applicator as that shown in FIG. 27;

FIG. 29 is a side view of the applicator of FIG. 27;

FIG. 30 is a cross-sectional view of the applicator taken from XXX-XXX of FIG. 29;

FIG. 31 is a perspective view of the applicator of FIG. 27 taken from an end thereof; and FIG. 32 is a partial view of the distal edge of the flexible blade of yet another exemplary embodiment of an applicator according to aspects of the present teachings.

MORE DETAILED DESCRIPTION

Reference will now be made in detail to exemplary embodiments of the invention, examples of which are illustrated in the accompanying drawings. Wherever possible, the same reference numbers will be used throughout the drawings to refer to the same or like parts.

The kit 1 shown in FIG. 1 may include an applicator 2 and a receptacle 3. The receptacle 3 may contain a supply of a substance P that is configured for application to keratinous materials, such as, for example fingernails and/or toenails (nails). According to various exemplary embodiments, the substance P may be a relatively viscous substance. By way of example only, the substance P may have a gel-like consistency during storage and may be thixotropic. The substance P may, for example, have a viscosity that is greater than about 0.3 Pa·s.

The applicator 2 may comprise a handle 5 and a flexible blade 6. The flexible blade may be configured to apply the substance P to nails.

The receptacle 3 may comprise a body 8 that defines a reservoir and a lid 9 configured to close the receptacle 3. The lid 9 may be provided with a sealing member 11, such as, for example, a gasket, a skirt, a membrane seal, or other suitable sealing mechanism, such that the receptacle 3 may be closed in a substantially leaktight manner via the lid 9 when not in use. The lid 9 may have screw threading thereon that is configured to engage with screw threading provided on a neck 27 of the receptacle 3. In lieu of or in addition to screw threading, those skilled in the art would recognize that other cooperating engagement mechanisms, such as, for example, snap-fit, friction fit, may be used to engage the lid 9 and the receptacle 3 for closure.

The lid 9 may have a chimney-like portion that defines a housing 10 configured to receive the blade 6 of the applicator 2 when the kit 1 is in a stored configuration, as shown, for example, in FIG. 1. The housing 10 may have an opening at an end of the housing that faces away from the lid 9 and may be closed at an end that is attached to the housing 10, as depicted in FIG. 1.

As depicted in FIG. 1, the longitudinal axis Y of the housing 10 may define an angle with the longitudinal axis X of the body 8 so as to improve the stability of the kit 1.

In the exemplary embodiment of FIG. 1, the handle 5 is hollow and the blade 6 connects to the handle 5 via an end portion 13 that is relatively thick compared to the distal end of the blade 6. The end portion 13 may have a solid, circular cross-section. The end portion 13 may be made in such a manner that, when the applicator 2 is positioned in the housing 10, the end portion 13 substantially closes (e.g., plugs) the opening of the housing 10. In various exemplary embodiments, the end portion 13 may be made of the same material as the flexible blade 6. In an alternative aspect, the end portion 13 and flexible blade 6 may be made of differing materials.

In an exemplary embodiment, the handle 5 may be made integrally with the blade 6, for example, by molding, as illustrated, for example, in the embodiment of FIG. 21.

With reference to FIGS. 2 and 3, the blade 6 of the applicator 2 of FIG. 1 may comprise a top wall 16 defining a rear side of the blade 6 (e.g., the side of the blade that faces in a direction opposite to the direction in which the application face faces). Two wing portions 18 may be connected to the top wall 16. The top wall 16 and the wing portions 18 together define the application face 15, as shown in FIG. 1. The application face 15 may have a generally concave shape. In exemplary embodiments, the application face 15 can define a developable surface, including, but not limited to, for example, a cylindrical surface.

As shown in FIG. 3, the distal edge 20 of the blade 6 may be rounded in plan view. A tip 24 of the distal edge 20 may have a radius of curvature rranging from about 4 mm to about 20 mm, for example. The blade 6 may be symmetrical about a longitudinal mid-plane.

A height hof the wing portions 18 may increase progressively from the tip 24 of the distal edge 20 to the handle 5, as shown in FIG. 2. The wing portions may have a point of inflection 23. In one exemplary aspect, the point of inflection 23 may be positioned closer to the tip 24 than to the handle 5.

As illustrated in FIG. 4, the top wall 16 may have a reduced thickness as compared to the wing portions 18. The reduced thickness may provide the top wall with increased flexibility, for example, as compared to the wing portions 18.

In a middle region of the blade 6, for example, a region situated substantially midway between the handle 5 and the tip 24 of the distal edge 20 (e.g., a region proximate section line IV-IV in FIG. 3), the application face 15 may have a curved shape, as shown in FIG. 4. The radius of curvature R of the middle region may be substantially constant and may range from about 4 mm to about 20 mm, for example. In an exemplary embodiment, the radius of curvature of the middle region may be about 7 mm.

In various exemplary embodiments, the radius of curvature rand/or the radius of curvature Rcan be infinite. By way of example, the blade 6 may have a distal edge that is rectilinear and perpendicular to its longitudinal axis and/or have a distal edge that is planar.

In various exemplary embodiments, such as, for example, the embodiment shown in FIGS. 1-3, the top wall 16 of the blade 6 may be substantially rectilinear and parallel to the longitudinal axis of the handle 5 as far as the thick portion 13. The application face 15 may be substantially cylindrical, having a generator line that is substantially parallel to the longitudinal axis of the handle 5.

According to various exemplary embodiments, the blade 6 may be made by molding a thermoplastic material, such as, for example, a thermoplastic elastomer. The curved shape of the blade may result from the molding process. In various exemplary embodiments, the blade 6 also may be reinforced, at least in some places, with a reinforcing member or a fiber filler.

In various exemplary embodiments, the kit 1 may be used as set forth in the following description. A user may open the receptacle 3 by removing the lid 9 so as to expose the substance P in the receptacle 3, for example, as illustrated in FIG. 5. The user may grasp the handle 5 of the applicator 2 and remove the applicator 2 from the housing 10. Once the receptacle 3 is in the opened configuration, as shown, for example, in FIG. 5, the user may place the blade 6 of the applicator 2 through an opening defined by the neck 27 of the body 8 so as to load the blade 6 with an amount of the substance P. The body 8 may be provided with a relatively large neck 27 defining a relatively large opening so as to facilitate the loading of the blade 6. In various exemplary embodiments, the diameter of the neck 27 may be at least 2 centimeters (cm), for example.

In order to load the substance P, the user may pat the substance P with the concave side of said blade 6 (e.g., the application face 15) facing in a direction toward the substance P. In accordance with other exemplary embodiments, for example, as depicted in FIG. 5, the user may use the blade 6 in a manner similar to a spoon by facing the concave side of the blade 6 (e.g., the application face 15) substantially upward (e.g., away from the substance P in the receptacle 3). If desired, the user can wipe off any excess substance P that is loaded onto the blade 6 on the edge of the neck 27.

After loading the blade 6 with an amount of substance P from the receptacle 3, the user may place the application face 15 (shown in FIG. 5) into contact with a surface of a nail O, as shown, for example, in the exemplary embodiment of FIG. 6. Once in contact with the nail O, the user may apply the substance P by moving the distal edge 20 of the blade 6 substantially from the lunula toward the free edge of the nail O.

During application of the substance P to the nail O, the top wall 16 of the blade 6 may deform (e.g., curve) and become concave on the side opposite the application face 15. Upon such deformation, the wing portions 18 also may deform in response to the deformation of the top wall 16. For example, the wing portions 18 may flatten to at least some extent.

According to various exemplary embodiments, as shown in FIG. 7, for example, the user may use his or her fingers to squeeze together the wing-like portions 18 of the blade 6 so as to modify the curvature of the application face 15 and/or of the distal edge 20, as desired. By way of example, the user may squeeze the wing-like portions 18 so as to adapt the shape of the application face 15 and/or the shape of the distal edge 20 to the nail to which the substance P is being applied.

Those skilled in the art would understand various modifications to the exemplary embodiments described herein for using the kit 1 and/or applicator 2 for application of a substance to nails. It should be understood that the invention is not limited to the exemplary embodiments described herein.

In various embodiments, for example, as illustrated in FIG. 8, the blade 6 may include splines 29 on its longitudinal edges that project from the application face 15. The splines 29 may extend along the blade 6 substantially parallel to a longitudinal axis of the blade 6.

The presence of the splines 29 may make it possible to provide a gap 32 between the application face 15 and the nail O, as shown in FIG. 9. The gap may have a substantially uniform thickness and facilitate a relatively even (e.g., uniform) deposit of the substance P to the nail O.

In accordance with other various exemplary embodiments, for example, as illustrated in FIG. 10, the top wall 16 may have a thickness that is greater than the thickness of the wing portions 18.

The blade 6 of the applicator 2 may have a variety of shapes, and the applicator 2 can optionally include a handle 5 onto which the blade 6 is fitted.

By way of example only, the blade 6 may initially be made substantially without a curved shape, but may become curved upon assembling the blade 6 on a handle of the applicator. In another exemplary embodiment, the blade 6 may have a substantially straight shape (e.g., not curved) upon assembly to the handle 5, but may be deformed to achieve a curved shape via manipulation (e.g., squeezing the wing-like portions 18) by the user during application of the substance P to the nails O.

As mentioned above, in various exemplary embodiments, the blade and handle of the applicator may be made integrally with one another. FIGS. 11-14 depict various exemplary embodiments of applicators in which the blade 6 is formed integrally with a handle portion 36, for example, by molding. The blade 6 can be made in such a manner as to be either plane or curved at rest. In either case, the blade 6 may be deformable, for example, via a user manipulating (e.g., squeezing) the blade 6, as discussed above, or via an adjustment member (not shown in FIGS. 11-14) configured to engage with the blade 6, as will be described in further detail below.

The shape of the distal edge 20 of the blade 6 can be rounded to a greater or lesser extent, or even rectilinear, as desired. For example, the curvature of the distal edge 20 may be selected based on the size and/or shape of the nail to which it is desired to apply substance. FIG. 11 illustrates an exemplary embodiment of a curved distal edge 20 and FIG. 12 illustrates an exemplary embodiment of a planar distal edge 20. Further, according to various exemplary aspects, over at least part of its length and between its longitudinal sides, the blade 6 may have a width that increases towards the distal edge 20, as shown in FIGS. 11-13, for example.

According to various exemplary embodiments, the applicator 2 can comprise a blade 6 at each of its ends. FIG. 13 depicts an exemplary embodiment of an applicator 2 having two blades 6 at opposite ends and made as a single part (e.g., integrally by molding). In the exemplary embodiment of FIG. 13, the blades 6 have differing sizes and/or shapes. This may make it possible to treat a wide variety of nails, for example, nails of differing sizes and/or shapes. However, it is contemplated that the blades 6 may also have the same size and shape. During use of the applicator, one of the blades 6 may serve as a handle portion for the user to grasp while applying substance to a nail with the other blade 6.

In various exemplary embodiments, the blade 6 may define an opening 37 therethrough (e.g., a hole), as shown in FIG. 14, for example. Such a hole 37 may make it possible to see at least a portion of the nail while it is being made-up. Moreover, a hole 37 may reduce the amount of substance loaded onto the blade 6.

As discussed above, in various exemplary embodiments, when the blade of the applicator is secured to a handle, the blade can be assembled on the handle in such a manner as to make it possible to adjust the curvature of the application face.

In the exemplary embodiment of FIG. 15, the handle 5 includes two tabs 38 that force the blade 6 to curve when the blade 6 is assembled to the handle 5. In the exemplary embodiment of FIG. 15, the blade 6 may be similar to the blade 6 of the FIG. 14, for example, including an opening 7 (e.g., a hole or a recess) in which the handle 5 can be engaged. The tabs 38 may bear against the outsides of the wings 18, for example, when the blade 6 is assembled with the handle 5.

The blade 6 can come to bear against the handle 5 via a proximal portion 39 that is remote from (e.g., at an opposite end from) the distal edge 20. The handle 5 can include a finger 42 that is provided with a notch (not shown) in which an edge of the opening 7 of the blade 6 can be engaged. In this way an edge of the opening 7 can be seated in the notch with one portion of the finger 42 that defines the notch resting on a first face of the blade 6 (e.g., the face visible in FIG. 15) and the other portion of the finger 42 defining the notch resting on a second face of the blade 6 opposite the first face (e.g., the face not visible in FIG. 15).

The handle 5 also may include catches 44 that make it possible to stretch the blade 2 over the handle 5 to a greater or lesser extent. The catches 44 may comprise, for example, portions in relief, projections, and/or other similar structures between which the proximal portion 39 of the blade 6 can be engaged. The blade 6 may be stretched between the notch of the finger 42 and the selected catch 44.

Thus, in the exemplary embodiment of FIG. 15, the handle 5, including the finger 42 and catches 44, may function as an adjustment member to deform the blade and thereby adjust the curvature of the blade 6.

In the exemplary embodiment of FIG. 16, an adjustment member 60 may be engaged with an outer surface of the blade 6 to cause the blade 6 to deform and curve the application face 15 to a greater or lesser extent, as desired. In various exemplary embodiments, the adjustment member 60 may comprise a ring, a loop, or other structure that engages the outer surface of the blade 6. Also, in various exemplary embodiments, the adjustment member 60 may be configured so as to be displaceable (e.g., slidable) along a length of the blade 6 to deform the blade 6 in a desired region of the blade 6 along its length. Those having ordinary skill in the art would appreciate that the adjustment member 60 could have a variety of configurations and need not be a structure that forms a closed loop or ring.

In various exemplary embodiments, a plurality of blades 6, which may or may not have differing configurations, may be provided. By way of example only, a plurality of blades 6 having precut shapes (which may comprise at least some of the same and at least some differing shapes and/or sizes) may be provided in a sheet 71 of flexible material, as shown in FIG. 17.

A kit 1 for applying a substance to nails may comprise the sheet 71 and a handle 5, as depicted in the exemplary embodiment of FIG. 17. A user can detach a desired blade 6 from the sheet 71 and assemble it on the handle 5. By way of example only, the user may assemble the blade 6 to the handle 5 in a manner similar to that described with reference to FIG. 15. The user may then load the blade 6 with substance from a receptacle, as described above. The kit 1 also may include the receptacle 3 containing the substance to be applied to the nails.

According to various exemplary embodiments, the kit 1 may comprise a plurality of blades 6 having differing or identical shapes. By way of example only, the blades 6 may be configured for either single-use or multiple use in the kit 1, and in various other embodiments described herein the blades may configured for single-use or for multiple uses.

FIG. 18 shows yet another exemplary embodiment of a kit 1 that includes a receptacle 3 that is in the form of a wide-necked pot. The applicator 2 can be housed in a housing 10 defined by a closure cap 82 of the receptacle 3. The housing 10 can be closed by a lid 83. The lid 83 may engage with the closure cap 82 in a variety of ways to close the housing 10, including, but not limited to, for example, screw threading, snap-fit detent mechanisms, friction fit, and/or other suitable engagement mechanisms. As shown in FIG. 18, the closure cap 82 may have screw threading configured to engage with screw threading on the receptacle 3 to close the receptacle 3. Those skilled in the art would recognize a variety of modifications that may be made to permit the closure cap 82 to removably engage with and close the receptacle 3 and to permit the lid 83 to removably engage with and close the closure cap 82.

With reference to the exemplary embodiment of FIG. 19, the receptacle 3 may be in the form of a flexible tube provided with a neck 92 configured to removably receive a cap 91 for closing and opening the receptacle 3. The receptacle 3 may be configured to contain the substance for application to nails. In order to load the substance, the user may squeeze the tube and place the outlet of the neck 92 of the tube over the application face of a blade 6 to deposit the substance thereon.

In yet another exemplary embodiment shown in FIG. 20, the blade 6 may be contained in a housing 101 of a support 100 that is disposed inside the receptacle 3 when the receptacle 3 is in a closed configuration.

A lid 102 may be configured to close the receptacle 3 and the housing 101. The support 100 may include an annular rim 105 that comes to bear against the top end of the receptacle 3. The lid 102 also may include a ring 104 that comes to bear in leaktight manner against the rim 105.

Numerous modifications may be made to the exemplary embodiments described herein; the exemplary embodiments shown and described are nonlimiting.

In various exemplary embodiments, the applicator (including, for example, the at least one blade) can be made, at least in part, from papermaking fibers in a woven or a non-woven fabric that is impregnated, for example, with a polymeric material that is compatible with the substance contained in the receptacle to be applied to nails. In various other exemplary embodiments, the blade may be made of metal, such as, for example, a shape memory metal, or of other material presenting shape memory, or of a foam of low porosity. The blade also may be covered in a skin on its application face. By way of example, the blade may be made out of paper or card, and may, in exemplary embodiments, be covered in a film. In various exemplary embodiments, the blade can include a reinforcing member, e.g. a metal reinforcing member, a non-woven fabric, and/or synthetic reinforcing fibers.

In various exemplary embodiments, an applicator made in accordance with the present teachings may be used in such a manner as to produce a "French manicure" effect, in which a substantially white substance is deposited approximately along the free edge of the nail.

To this end, any of the above-described applicators can be modified in such a manner as to present a free concave distal edge 20 when observed from above, as shown, for example, in FIG. 32. The blade can define a developable application surface.

In the exemplary embodiment shown in FIGS. 22 to 26, the blade 6 is made integrally with a handle 5 (e.g., a hollow handle) by molding a thermoplastic elastomer material. By way of example, the thermoplastic elastomer material may be Santoprene® 82 8135med from EXXON MOBIL which is a mixture of styrene-butadiene-styrene/styrene-ethylene-butylene-styrene (SBS-SEBS) and may have a hardness of 35 on the Shore A scale. In another example, the material may be Engage® 8137 from SAFIC ALCAN DOW which is an octene ethylene and may have a hardness of 57 on the Shore A scale. Other thermoplastic elastomer materials also may be suitable and the examples above are nonlimiting.

As shown in FIG. 23, the blade 6 may be made with an opening 200 configured to increase the flexibility of the blade 6. For example, the opening 200 may be formed in the top wall 16 that forms a rear side (e.g., the side facing in a direction opposite to the application face) of the blade 6. The opening 200 may be configured so as to enable the blade 6 to deform during application of a substance to a nail, for example, when the user presses the distal edge 20 of the blade against the nail.

By way of example, the opening 200 may have a generally triangular shape, the base 201 of the triangle possibly being rectilinear or curvilinear, e.g. circular when the distal edge 20 of the blade 6 is circular, and may have the same center of curvature. The opening 200 may extend through the thickness of the top wall 16, thereby forming a hole therethrough, or may extend only partially through the thickness of the top wall 16, thereby forming a recess.

In the exemplary embodiments of FIGS. 21-26, the blade 6 can be made with a wall thickness that is less than a wall thickness of the handle 5, as is best shown in FIG. 25. For example, the handle 5 may have a wall thickness that is at least twice the thickness of the blade 6. For example, the wall thickness of the blade may be less than or equal to about 1 mm, e.g. about 0.5 mm, whereas the thickness of the handle greater than or equal to about 1 mm.

In various exemplary embodiments, decorative beads 203 can be formed on the handle 5, as shown in FIGS. 22 to 24.

The application face 15 of the blade 6 may define a developable application surface, such as, for example, a cylindrical surface.

In the exemplary embodiment depicted in FIGS. 27 to 31, the applicator comprises two flexible blades 6, one at each of its ends. The flexible blades 6 may have dimensions, shapes, and/or profiles that differ from each other so as to make it possible to produce differing effects (e.g., at least two differing makeup effects) and/or to apply substance to nails of differing sizes (e.g., at least two differing sizes).

In the exemplary embodiment of FIG. 27-31, one of the blades presents a distal edge 20 that is shorter and has a radius of curvature that is smaller than the radius of curvature of the other blade, so as to facilitate application of the a substance to smaller nails. The two flexible blades 6 may be interconnected via a connection portion 205 that can serve as a handle, making it possible during application for the user to take hold of the flexible blade that is not being used, in order to use it as a handle.

The connection portion 205 may be at least somewhat deformable to allow the user to modify the angle $\alpha$ between the rear side of the flexible blades 6 (e.g., between the longitudinal axes of the rear sides of the blades 6). The angle $\alpha$ may range from about 110° to about 150°, for example, the angle $\alpha$ may be about 130°, at rest, for example.

The radius of curvature of the smaller flexible blade 6 in the section plane in FIG. 30, measured along the outside surface of the blade, may range from about 6 mm to about 7 mm, for example, and the thickness of the blade 6 may be 0.7 mm, for example.

The width l, measured in plan view, of the distal edge of one of the blades 6 may range from about 8 mm to about 9 mm, for example, and the width l' of the distal edge of the other blade may range from about 10 mm to about 11 mm, for example.

In various exemplary embodiments, the connection portion 205 is formed with a rear side 220 (e.g., which faces away from the nail during use of the applicator 2 for applying substance to nails) and two side walls 221, as shown in FIG. 28. The walls 221 may curve inwardly toward each other in a middle region, as shown.

The term "comprising a" should be understood as being synonymous with the term "comprising at least one", and "ranging from . . . to" should be understood as including the limits of the range.

Although the present invention herein has been described with reference to various exemplary embodiments, it is to be understood that these embodiments are merely illustrative of the principles and applications of the present invention. Those having skill in the art would recognize that a variety of modifications to the exemplary embodiments may be made, including modifications to the number and arrangement of various parts, materials, and methodologies, for example, without departing from the scope of the invention.

Moreover, it should be understood that various features and/or characteristics of differing embodiments herein may be combined with one another.

It is therefore to be understood that numerous modifications may be made to the illustrative embodiments and that other arrangements may be devised without departing from the present invention.

What is claimed is:

1. An applicator for applying a substance to nails, the applicator comprising:

at least one curved flexible blade defining an application face that is generally concave, the at least one flexible blade being connected by a proximal end to a handle and being elongate between the proximal end and a distal end, wherein the at least one flexible blade comprises a rear side having a surface facing opposite to the application face and wing portions extending from the rear side, the wing portions defining bearing surfaces configured to not be loaded with the substance and configured to be grasped by fingers of a user to modify a curvature of the at least one flexible blade.

2. The applicator of claim 1, wherein the at least one curved flexible blade comprises an elastomeric material having hardness ranging from about 25 Shore A to about 60 Shore A.

3. The applicator of claim 1, wherein the at least one curved flexible blade and the handle are made integrally with each other by molding.

4. The applicator of claim 1, further comprising a first curved flexible blade and a second curved flexible blade.

5. The applicator of claim 4, wherein each of the first and second curved flexible blades comprises a rear side having surfaces that face in a direction opposite to the respective application face of each of the first and second curved flexible blades, the rear sides of the first and second curved flexible blades defining an angle there between.

6. The applicator of claim 5, wherein the angle ranges from about 110° to about 150°.

7. The applicator of claim 4, wherein the first and second curved flexible blades are joined together via a connection portion having two side walls that extend from longitudinal sides of each of the first and second curved flexible blades.

8. The applicator of claim 7, wherein the two side walls bend inwardly toward each other.

9. The applicator of claim 1, wherein the application face defines a developable application surface.

10. The applicator of claim 9, wherein the application surface comprises a cylindrical surface.

11. The applicator of claim 1, wherein the rear side defines an opening.

12. The applicator of claim 11, wherein the opening has a generally triangular shape with a base proximate a distal edge of the at least one curved flexible blade.

13. The applicator of claim 1, wherein the at least one curved flexible blade comprises a distal edge that is generally convex when observed from a surface of the at least one curved flexible blade that faces in a direction substantially opposite to the application face.

14. The applicator of claim 1, wherein the at least one curved flexible blade comprises a distal edge that is generally concave when observed from a surface of the at least one curved flexible blade that faces in a direction substantially opposite to the application face.

* * * * *